US006145347A

United States Patent [19]

Plath

[11] Patent Number: 6,145,347

[45] Date of Patent: Nov. 14, 2000

[54] THREAD SUPPLYING DEVICE FOR INTERMITTENT THREAD CONSUMPTION

[75] Inventor: Ernst-Dieter Plath, Albstadt, Germany

[73] Assignee: SIPRA Patententwicklungs- u. Beteiligungsgesellschaft mbH, Ablbstadt, Germany

[21] Appl. No.: 09/046,439

[22] Filed: Mar. 24, 1998

[30] Foreign Application Priority Data

Mar. 26, 1997 [DE] Germany ..... 197 12 739

[51] Int. Cl.[7] ..... D04B 15/14

[52] U.S. Cl. ..... 66/132 T; 242/366

[58] Field of Search ..... 66/132 R, 132 T; 242/364.12, 364.2, 366, 366.2

[56] References Cited

U.S. PATENT DOCUMENTS

| | | | |
|---|---|---|---|
| 3,491,963 | 1/1970 | Schlumph | 242/364.12 |
| 4,457,144 | 7/1984 | Sawazaki | 66/132 T |
| 4,598,560 | 7/1986 | Sawazaki | 66/132 T |
| 4,890,464 | 1/1990 | Tsuchiya et al. | 66/132 T |
| 4,996,852 | 3/1991 | Kawase et al. . | |
| 5,141,170 | 8/1992 | Sarfati | 242/364.2 |
| 5,388,747 | 2/1995 | Chen | 66/132 R |
| 5,669,245 | 9/1997 | Shieh | 66/132 T |

FOREIGN PATENT DOCUMENTS

| | | |
|---|---|---|
| 0 436 313 A2 | 7/1991 | European Pat. Off. . |
| 177 577 | 11/1906 | Germany . |
| 35 06 552 A1 | 9/1985 | Germany . |
| 94 00 778 | 4/1994 | Germany . |
| 195 11 949 A1 | 10/1996 | Germany . |
| 95 00 543 | 3/1995 | Spain . |
| 1 578 661 | 11/1980 | United Kingdom . |

*Primary Examiner*—Andy Falik
*Attorney, Agent, or Firm*—Michael J. Striker

[57] ABSTRACT

A thread supplying device with intermittent thread consumption has at least one thread supplying unit including a rotatable thread supplying drum and a thread supplying device. The thread supplying drum has a first and a second peripheral portion forming corresponding friction surfaces for a thread to be supplied. The thread supplying device has an inlet element associated with the first peripheral portion and an outlet element associated with the second peripheral portion, and also has two movable guiding elements for the thread and associated with the peripheral portions. The thread is guided by the guiding elements between the inlet and the outlet element and cooperates successively with the first and the second peripheral portion and placed on an associated one of the peripheral portions in a supplying position of the guiding elements along a greater peripheral angle than in a non supplying position of the guiding elements.

14 Claims, 3 Drawing Sheets

THREAD SUPPLYING DEVICE FOR INTERMITTENT THREAD CONSUMPTION

BACKGROUND OF THE INVENTION

The present invention relates to a thread supplying device for intermittent thread consumption.

Known thread supplying devices of this type are disclosed for example in the patent documents DE35 06 552 A1, ES-PS 9 500 543, DE 94 00 778 U1. These devices in particular in knitting machines are used during intermittent thread consumption either to supply a thread with a smallest possible thread tensioning to a machine which consumes the thread or to interrupt the thread supply. This is needed for example in round knitting machines with: stripers, with which several threads with different properties, for example colors, can be treated on one knitting location. A correspondingly selected thread is therefore supplied and introduced into the knitting needles of the knitting machine, while all other threads of the same stripers are held outside of the knitting region and not introduced into the knitting needles. The exchange of a directly supplied thread to another thread which is to be supplied later is performed in a known manner, for example as disclosed for example in the German patent document DE 195 11 949 A1, by means of turnable thread guide fingers as well as cutting and clamping elements and does not have to be explained for a person skilled in the art. Alternatively, the above described thread supplying devices can be used for example in cases in which only a single thread must be supplied or not supplied to a corresponding knitting system in accordance with a pattern.

In order to guarantee a good thread transportation during the thread supplying phases, the thread supplying drums in the known thread supplying devices are provided with two peripheral portions alternatingly acting to the threads to be supplied, which portions are separated from one another in the axial direction in the thread drum and provided for the possibility to bring the threads along a relatively great peripheral angle in contact with the friction surfaces of the supply drum. In contrast, for performing a fast exchange between supplying and not supplying or visa versa a control lever is provided with two guiding elements, through which the threads which abut in a supply position of the control lever along the relatively great peripheral angle on both peripheral portions, in a non supplying position of the control lever alternatingly act only along a relatively small peripheral portion with the thread drum and therefore are not supplied.

Since in fast running round knitting machines the transition between maximum thread consumption and thread stoppage or visa versa is performed very fast, the thread supplying device must be also formed so that it reacts fast during a corresponding exchange. For this purpose the control lever as a rule is formed as a spring and arranged so that with stopped thread its non supplying position is assumed. During the beginning of a thread consumption from the side of the round knitting machine and the like, the control lever is then automatically moved against the spring force into its supply position, so that the thread is supplied. In contrast, when the thread consumption ends the control lever under the action of the spring force is automatically moved back into the non supplying position.

Finally, it is known to provide the supplying devices for taking into consideration different thread properties, with further, manually adjustable guiding elements. With these elements, the peripheral angle along which the thread alternatingly cooperates with the two peripheral portions, can be changed. This is disclosed for example in the German patent document DE 35 06 552 A1.

Thread supply devices of this type have several basic disadvantages. For a good thread supply with low thread tension it is for example desirable to provide as good friction surfaces as possible, or in other words surfaces with high friction values or friction coefficients with respect to the utilized threads and to place the threads with a sufficiently great peripheral angle on the peripheral portions. For a fast thread stoppage during transition of the thread supplying device to the non supplying position to the contrary the smallest possible friction values and smallest possible peripheral angle is desired. These both requirements can not be brought optimally in coordination with one another, so that the threads can be supplied either with not sufficiently small tension or during transition to the non supplying position have the tendency to remain glued to the second peripheral portion and not to wind on it until they are torn off. A further disadvantage is that the advantage obtained with the second peripheral portion to provide double grade thread placement surface is at least partially eliminated in that the threads due to the required guiding and conducting elements are deviated many times so much that high friction occurs. Finally, it is disadvantageous that an optimization of the control lever which is advantageous in certain circumstances is reduced due to narrow space conditions and from other structural reasons. Therefore, in the known thread supplying device of the above described type, either no sufficiently small thread tension is obtainable or problems with fast transition from the supplying position to non supplying position due to the described glueing action can be expected. Moreover with respect to the thread tensions and also the glueing properties, a desired dependency on the thread material, such as for example polyester, acetate, takes place, so that frequently special adaptation of the thread material selected for the individual cases is needed.

SUMMARY OF THE INVENTION

Accordingly, it is an object of present invention to provide a thread supplying device of the above mentioned type which is formed so that it provides required thread tension, reliably avoids winding of the thread on the peripheral portions and is substantially independent from the utilized thread material.

In keeping with these objects and with others which will become apparent hereinafter, one feature of present invention resides, briefly stated, in a thread supplying device for intermittent thread consumption, in which both peripheral portions of the thread supplying drum have different thread supplying properties and/or the guiding elements are associated with two separate control levers.

With the present invention, the above mentioned disadvantage can be eliminated when both peripheral portions are not as up to now formed identically and/or are combined with a single control lever having two guiding elements, but instead in corresponding with the requirements are formed differently and/or combined with separate control levers. Thereby, it is for example possible to optimize the first peripheral portion with respect to the thread transportation and the desired small thread tension, and to optimize the second peripheral portion with respect to the avoiding of undesired glueing action.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
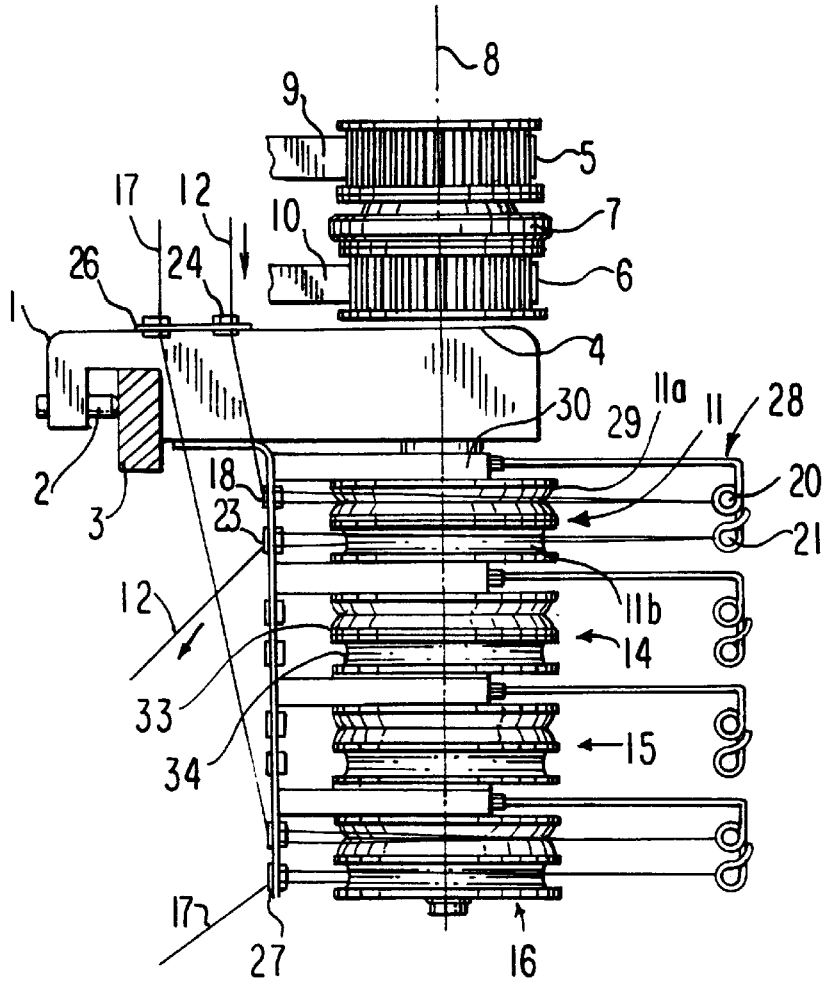
FIG. 1 is a schematic side view of a thread supplying device in accordance with the present invention.
Figure 2:
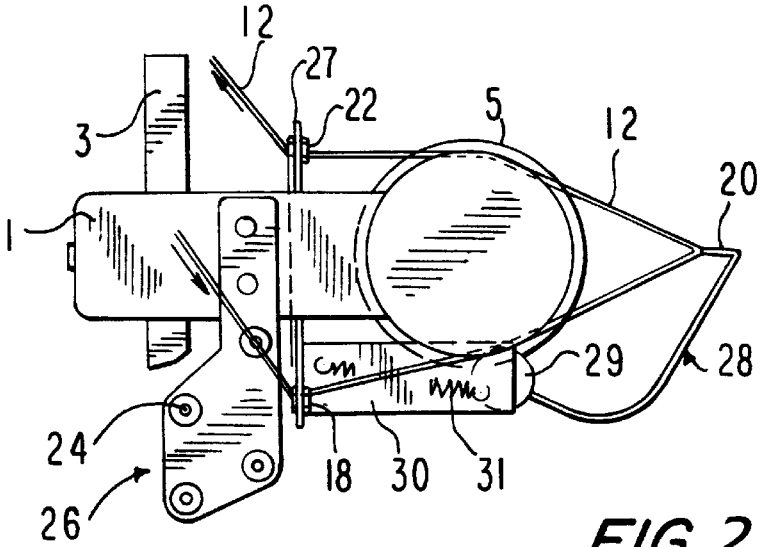
FIG. 2 is a plan view of a thread supplying device of FIG. 1 in a non supplying position.
Figure 3:
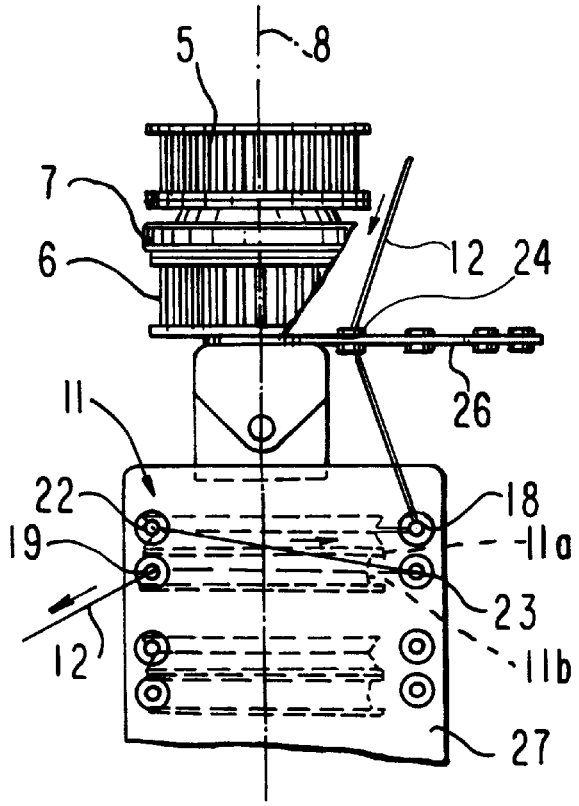
FIG. 3 is a partial rearview of the thread supplying device as seen from the left side in FIG. 2.

FIGS. 1–3 show the thread supplying device in accordance with the present invention, for example for a striper. It has a holder 1 which can be mounted by a screw 2 on a mounting rail 3 of a machine which consumes a thread, for example a round knitting machine. A drive shaft 4 is rotatably supported in the holder 1. Two drive disks 5 and 6 are coaxially and rotatably supported on its end projecting outwardly from the holder 1. They are formed for example as belt pulleys.

A manually switchable coupling disk 7 is supported coaxially between both drive disks 5 and 6 on the drive shaft 4 so that it is non rotatably connected with the drive shaft 4 but can displace in direction of a joint rotary axis 8 and thereby can be non rotatably coupled selectively with the drive disk 5 or the drive disk 6. The both drive disks 5 and 6 are turned to rotation, for example, by conventional drive elements 9 and 10, such as for example belts or toothed belts. The drive elements for to the same diameter of the driven disks 5 and 6, can be drive with different speeds, and with different diameters of the drive disks 5 and 6 can be driven with the same speeds. Alternatively it is however possible to provide only one drive disks, in which case the drive shaft 4 can be drive only with one rotary speed.

At least one thread supplying drum 11 is mounted on an end of the drive shaft 4 which is passed downwardly from the holder 1. It has a first and a second coaxial peripheral portion 11*a* and 11*b*, each having a friction surface for a thread 12 to be supplied. Both peripheral portions 11*a* and 11*b* are separated from one another in direction of the rotary axis 8. The thread supplying drum 11 is the component of a first thread supplying unit of the thread supplying device. Since in the shown embodiment a thread supplying device for a striper is utilized, total four such thread supplying units are provided each being associated, for example with a respective one of four identical thread supplying drums 11, 14, 15, 16 mounted one under the other on the drive shaft. Each thread supplying unit operates for supplying a corresponding one of four threads to the round knitting machine and the like. FIG. 1 shows only one thread 17 associated with the thread supplying drum 16. The four thread supplying drums 11, 14, 15, 16 are in other aspects substantially identical, so that the present invention will be described hereinbelow with respect to the thread supplying drum 11.

Each thread supplying unit has, in addition to an associated thread supplying drum 11, 14, 16, also an associated thread supplying device. Since all thread guiding devices are formed substantially identical, subsequently only such thread guiding device is described which has the thread supplying drum 11 and is associated with a predetermined thread supplying unit for supplying the thread 12. The thread guiding unit has an inlet element 18 associated with the first peripheral portion 11*a*, an outlet element 12 associated with the second peripheral portion 11*b*, two guiding elements 20, 21 and two additional conducting elements 20 and 23 as shown in FIG. 3. The different elements 18–23, depending on the demand, are formed as closed or open ears, hooks or the like. An additional ear 24 can serve for applying a thread coming from a supply coil to the inlet opening 18.

The ear 24 is formed in the shown embodiment in a plate 26 which is placed above the thread drum 11 perpendicularly to the rotary axis 8 and mounted on the holder 11 as shown in FIG. 2 which has corresponding ears for the remaining thread, for example 17. In contrast the inlet and outlet elements 18, 19 and the conducting elements 22, 23 are formed in the plate 27 which is arranged parallel to the rotary axis 8 and also mounted on the holder 1. The plate 27 is arranged on the rear side of the thread supplying device with a small distance from and substantially tangential to the thread supplying drums 11, 14, 15, 16. It extends substantially over the whole length of the part extending downwardly from the holder 11.

Finally, the thread guiding device contains a control lever 28 which is formed for example from a thin steel wire. The control lever 28 is mounted with its rear end on the periphery of a circular disk 29 shown in FIG. 2. The disk 29 is supported rotatably in a housing 30 and oriented with its rotary axis parallel to the rotary axis 8. One end of a spring 31 which is formed for example as a pulling spring engages on the periphery of the disk 29. Its other end is rigidly fixed in the housing 30. The both guiding elements 20, 21 are arranged on the other end of the control lever 28. They can have either ear-shaped bands of the steel wire or the corresponding inserts. As shown in FIG. 1, the connecting element 20, 21 are located over one another on one parallel to the rotary axis 8 and arranged so that the guiding element 20 is associated with the peripheral portion 11*a* and the guiding element 21 is associated with the peripheral portion 11*b*.

Figure 4:
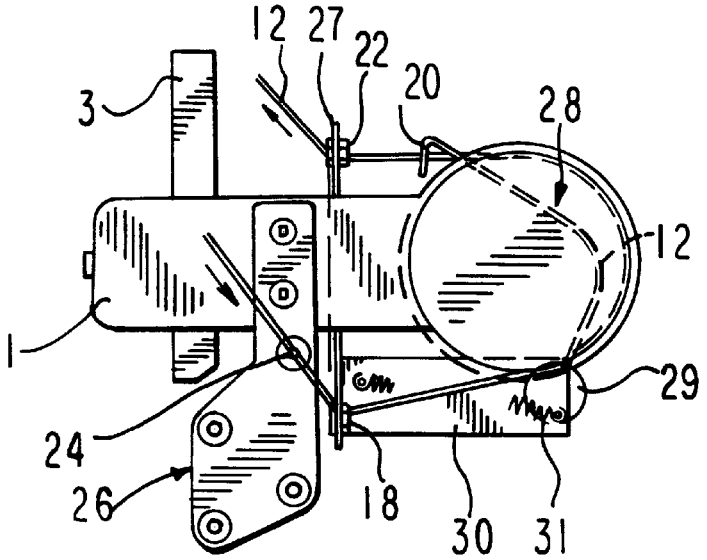
FIG. 4 is a view substantially corresponding to the view of FIG. 2 of the thread supplying device, but in a supplying position.

The two outlet elements 18,19, and the conducting elements 20 and 23 are rigidly arranged during the operation of the thread supplying device. The plate 26, 27 when knitted can be however adjustably connected with the holder 1. In contrast, the guiding elements 20, 21 are supported movably during the operation of the thread supplying device since the control lever 28 which carries them can reciprocatingly turn between a non supplying position shown in FIG. 2 and supplying position as shown in FIG. 4.

As can be seen from FIGS. 1–3, the thread 12 is guided between the inlet element 18 and the outlet element 19 so that it alternatingly cooperates first with the first and then with the second peripheral portion 11*a* or 11*b* of the thread supplying drum 11. With the shown embodiment, the thread 12 extends one after the other through the inlet element 18, the guiding element 20, the conducting elements 22 and 23, the guiding element 21 and the outlet element 19. The elements 18, 20 and 22 preferably are arranged substantially at the height of the central plane of the peripheral portion 11*a* and the element 20, 21, 23 are arranged preferably substantially at the height of the central plane of the peripheral portion 11*b*. Moreover, the thread 12 as shown in FIG. 3 is guided between the conducting elements 22 and 23 on the rear side of the plate 27.

Furthermore, the arrangement is formed so that the thread 12 with the control lever 28 located in the non supplying position between the guiding element 20 and the elements 18 or 22 on the one hand, and the guiding element 21 and the elements 19, 23 on the other hand, is in contact only along a relatively small peripheral angle with the peripheral portions 11*a*, 11*b* as shown in FIG. 2. Finally, the arrangement is formed so that the thread 12 with the control lever 28 located in the supply position shown in FIG. 4 moves in contact around a relatively great peripheral angle with the peripheral portions 11*a*, 11*b*. As a result, the control lever 28 in its supplying position is turned so that the guiding elements 20, 21, in contrast to FIG. 2, are located not on a side of the thread supplying drum 11 which faces away from the plate 27, but instead is the same size as the plate 27 and thereby between the conducting element 22 or the outlet element 19 and the thread supplying drum 11. In particular it can be seen from the comparison of FIGS. 2 and 3 that the thread 12 surrounds the associated peripheral portions 11*a*, 11*b* with the control lever 28 located in the supplying position, for example along a peripheral angle of each approximately 180°, and with the control lever 28 located in a non supplying position around only along the peripheral angles of total substantially 50° each.

Since the turning of the control lever 28 to one or another position is not prevented by the thread supplying drums 11, 14, 15, the housing 30 is arranged in correspondence with FIG. 1 preferably axially above or below the associated thread supplying drum 11, 14, 15, 16, while the guiding element 20, 21 are formed on the end portions of the control lever 20 which are bent by 90°.

Thread supplying devices of the above mentioned general type are general known and disclosed for example in the patent document DE 35 06 552 A1, ES-PS 9 500 543, DE 94 00 778 U1, and therefore they don't have to be explained in detail.

In the known thread supplying devices the peripheral portions 11*a*, 11*b* are formed substantially identically. In contrast, in accordance with an embodiment of the invention, it is proposed to provide the peripheral portions 11*a*, 11*b* with different thread supplying properties. In particular, it is proposed in the first peripheral portions 11*a* as considered in the thread supplying direction with better thread supplying properties than the subsequent peripheral portion 11*b*. The term "better thread supplying properties" has the meaning that the first peripheral portion 11*a* is formed so that, substantially independently from the utilized thread material and from the thread supplying properties of the second peripheral portion 11*b*, favorable friction ratios are provided. In particular, the thread 12, with the control lever 28 in the supplying position must be transported so well that the ratio of the thread tension before the thread supplying device to the thread tension after the thread supplying device amounts to at least 2.5. This can be obtained for example in that the peripheral portion 11*a* is produced of a material with favorable friction properties or coated with such a material. It is especially advantageous for this purpose to use the materials with a Shore-A-hardness of approximately 8–100, in particular various synthetic plastics. The best results are obtained with polyurethane and a material which is produced by the Fa.Bayer AG, Leverkusen under the trade name "VULKOLLAN".

Moreover it can be advantageous to form a part of the peripheral portion 11*a* which is contact with the thread, or in other words the friction surface itself as a V-shaped receiving groove. This is shown in FIG. 1 for the upper peripheral portion of the thread supplying drums 14, 15, 16 corresponding to the peripheral portion 11*a* and identified with in connection with the thread supplying drum 14 by the reference numeral 33. The receiving groove 33 is limited for example by two wall parts which form an angle of approximately 90°. With the use of the conventional manufacturing technique of the V grooves, a radius is formed on the groove bottom which is so great that the thread can not be clamped at any pointed inside the receiving groove 33, as desired for example for forming of V grooves for reliable driving of a wedge belt. In accordance with the present invention the receiving groove 33 must not serve the purpose of clamping the thread. At the outlet side there would be the danger that the thread is not released from the receiving groove 33 but instead is wound on the peripheral portion 11*a*, which must be avoided. With the receiving groove 33 it must be also achieved that the thread at least partially abuts against the groove walls and therefore against a greater friction surface which moves with a greater rotary speed than if it were abutted only against the groove bottom or the bottom of a flat groove. This effect can be advanced when the elements 18, 20 and 22 are arranged so that the thread does not lye exactly in the symmetrical plane of the receiving groove 33.

With all or some of the above mentioned features, the peripheral portion 11*a* can be optimized in the sense of favorable thread transportation, and each individual case the favorable ratio can be easily obtained by experiments. It can be shown in the surprising manner that the thread part wondering from the peripheral portion 11*a* despite this optimization has no tendency to adhering or winding over, which probably is taken back on the tensely holding action of the second peripheral portion 11*b* on this thread part.

The second peripheral portion 11*b* which is the lower portion of FIG. 1 is formed in accordance with the present invention differently than the first peripheral portion 11*a*. For avoiding adherence of the thread, in particular during turning the control lever 28 to the non supplying position and thereby for fast holding of the thread 12 when it is no longer used by the round knitting machine, the part of the peripheral portion 11*b* which has a friction surface coming in contact with the thread 12 for example is formed as a flat groove. This is shown in FIG. 1 for all lower peripheral portions corresponding to the peripheral portion 11*b*. The flat receiving groove of the portion of the thread supplying drum 14 which corresponds to the peripheral portion 11*b* is identified with reference numeral 34. Thereby the thread 12, independently from its orientation, is always only in contact with the bottom of the receiving groove 34, so that it has a low tendency for adherence, and during turning of the control lever 28 to the non supplying position is released from the groove bottom and thereby makes possible the slippage on the peripheral portion 11*b* which is required for fast holding of the thread 12. This effect can be alternatively obtained or additionally advanced when the peripheral portion 11*b* is composed of a material which has worse supplying properties than the first peripheral portion 11*a*, or is coated with such a material. Examples for such materials are in particular different, relatively soft rubber types with Shore-A-hardness of for example 50 and lower.

With all or some of these features the peripheral portion 11*b* can be optimized in the sense of a favorable ratio during transition to the non supplying position, and the individual cases the favorable ratio can be easily obtained by experiments. The features that the second peripheral portion 11*b* has substantially worse thread supplying properties is critical for the purpose of the invention, since the main part of the thread transportation is taken by the first peripheral portion 11*a* which is optimized for this purpose. Also, during transition from the non supplying position to the supplying position no disadvantageous actions have been shown.

The experiments have shown in surprising manner that the thread supplying device in accordance with the present invention operates without problems also when threads having high tendency for adherence are utilized, such as for example acetate threads. Moreover, also during the use of such threads a sufficient reduction of the thread tension in the thread supplying direction behind the thread supplying device is obtained.

The utilization of a control lever 28 which carries both guiding element 20, 21 has the advantages and also disadvantages. It is advantageous that a quite thread supply is provided and the control lever 28 has a low inclination continuously wondering between its supplying position and its non supplying position. Disadvantageous is however that the guiding element 20 which is associated with the first peripheral portion 11*a* prevents a fast turning of the control lever 28 to the non supplying position. Since the thread speed is controlled on a point located in the thread supplying direction behind the thread supplying device, by the thread consumption in the round knitting machine or the like intermittently, a relaxation of the thread consumption on the thread part which is guided by the guiding element 21 acts so that during the relaxation of the thread consumption on the thread part guided by the guiding element 20 a certain delay can take place since this thread part is first substantially tensely held by the action of the second peripheral portion 11*b*. Therefore the control lever 28 can not be turned so fast as in the case when it is carried by the guiding element 21 and there is the danger that the thread despite ending of the thread consumption, is advanced for a short time further. Thereby it is either wound on the peripheral portion 11*b* or forms an undesired thread loop between the supplying device and the round knitting machine and the like.

Figure 5:
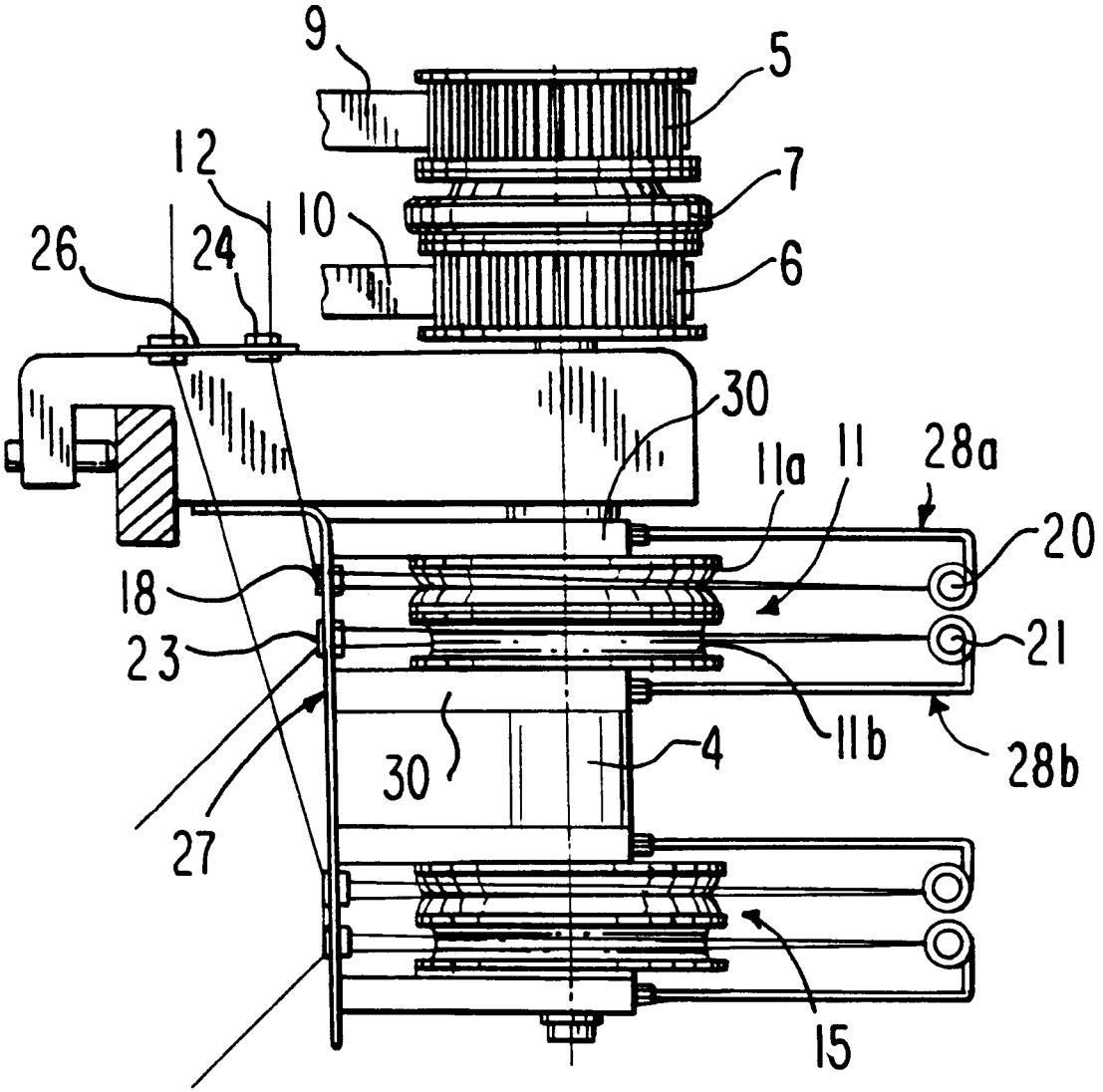
FIG. 5 is a view substantially corresponding to the view of FIG. 1 but showing a second embodiment of the inventive thread supplying device.

In order to eliminate this effect, alternatively or additionally the both guiding elements 20, 21 can be each mounted on a separate control lever 28*a*, 28*b* as shown in FIG. 5 for a thread supplying device which in contrast to FIG. 1 has only the both supplying drums 11 and 15. Thereby the number of the control levers 28 is doubled, which is connected with an increased structural expense. A substantial advantage of this feature is however the guiding element 21 which is associated with a lower peripheral portion 11*b* after relaxing the thread consumption can be turned abruptly and independently together with the associated control lever 28*b* to the non supplying position, to provide a disk type point the thread tension in the region of the first peripheral portion 11*a* with turning back the control lever 28*a* which carries the guiding element 20. In this embodiment of the invention it is possible to form the second peripheral portion 11*b* in the sense of a good thread supply, or in other words with a friction surface composed of polyurethane or VULKOLLA or with a V-shaped groove since in this case the fast turning back of the second control lever 28*b* substantially prevents adherence of the thread to the second peripheral portion 11*b*. It is clear that in this case the both control levers 28*a*, 28*b* are tensioned by a spring each corresponding to the spring 31 in the non supplying position. In other aspects, the embodiment of FIG. 5 corresponds to the embodiment of FIG. 1, and the same parts are identified with same reference numerals.

The invention is not limited to the above described embodiments which can be modified in many ways. For example it is possible to arrange the peripheral portions 11*a*, 11*b*, and the supplying drums 11, 14, 15, 16 differently they shown and to form, in particular a single drum body which has all peripheral portions required for a stripper. Moreover, more or less than four thread supplying drums 11, 14, 15, 16 can be provided. In many applications also a single thread supplying drum is sufficient. Furthermore, it is possible to provide other constructions for the control lever and other locations for its supplying and unsupplying positions. Also, the thread supply between the both guiding elements 20, 21 can be different than the one shown. Particularly, at least one or all of the guiding elements 20, 21 can also consist of a pair of guiding means, e.g. eyelets, which guiding means are arranged one behind the other in the direction of travel of the thread and which are preferably so arranged relatively to each other that a common axis protruding both guide means is substantially arranged parallel to a diameter of the thread supplying drum 11 in the supplying position and substantially tangentially to the thread supply drum 11 in the non supply position.

Moreover, it is advantageous to select the rotary speed of the drive shaft 4 so that the thread supplying device operates during the advancement of the thread always with a certain average magnitude of slippage, or in other words, a peripheral speed of the peripheral portions 1*a*, 11*b* is greater than the greatest speed which is provided by the machine which uses the threads during maximum consumption. It is advantageous to select the peripheral speed of the peripheral portions 11*a*, 11*b* at least substantially 30% greater than the maximum delivery speed, while it is of course clear that the favorable rotary speed can be determined in each individual case by experiments. Further, the friction values for the peripheral portions 11*a*, 11*b* are variable. For the peripheral portion 11*a* the friction value can be considered as suitable up to 0.7, while higher values bring less advantages. The friction value for the peripheral portion 11*b* can be selected substantially at 0.3. In contrast, as for the peripheral angle, it is provided that in the supplying position above 200° no substantial improvements occur, while in the non supplying position the peripheral angle of less than 90° must be available. Finally, it is to be understood that the individual feature of the present invention can be also provided in other combinations which are not shown and described here.

It will be understood that each of the elements described above, or two or more together, may also find a useful application in other types of constructions differing from the types described above.

While the invention has been illustrated and described as embodied in thread supplying device for intermittent thread consumption, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A thread supplying device with intermittent thread consumption, comprising at least one thread supplying unit including a rotatable thread supplying drum and a thread guiding device, said thread supplying drum having a first and a second peripheral portion forming corresponding friction surfaces for a thread to be supplied, said thread guiding device having an inlet element associated with said first peripheral portion and an outlet element associated with said second peripheral portion, said thread guiding device also having at least two movable guiding elements for the thread, each of said guiding elements being associated to one of said peripheral portions for guiding the thread in such a manner between said inlet element and said outlet element that it cooperates successively with said first and said second peripheral portions and is placed on an associated one of said peripheral portions in a supplying position of said guiding elements along a greater peripheral angle than in a non supplying position of said guiding elements, said first and second peripheral portions having different thread supplying properties.

2. A thread supplying device as defined in claim 1, wherein said first peripheral portion has higher friction coefficients than said second peripheral portion.

3. A thread supplying device as defined in claim 1, wherein said friction surface of said first peripheral portion is composed of polyurethane.

4. A thread supplying device as defined in claim 1, wherein said friction surface of said first peripheral portion is composed of VULCOLLAN.

5. A thread supplying device as defined in claim 1, wherein said friction surface of said peripheral portion is composed of a material with a Shore-A-hardness of 80–100.

6. A thread supplying device as defined in claim 1, wherein the friction surface of said second peripheral portion is formed as a flat groove.

7. A thread supplying device as defined in claim 1, wherein said friction surface of said second peripheral portion is composed of a rubber-like material.

8. A thread supplying device as defined in claim 1; and further comprising a joint control lever on which both said guiding elements are mounted.

9. A thread supplying device as defined in claim 8; and further comprising a spring arranged so that said control lever is pretensioned by said spring in a position in which both said guiding elements (20, 21) assume their non supplying position.

10. A thread supplying device with intermittent thread consumption, comprising at least one thread supplying unit for supplying a thread, said thread supplying unit including a rotatable thread supplying drum and a thread guiding device, said thread supplying drum having a first and a second peripheral portion forming corresponding friction surfaces for said thread, said thread guiding device having an inlet element associated with said first peripheral portion and an outlet element associated with said second peripheral portion, said thread guiding device also having at least two movable guiding elements for said thread, each of said guiding elements being associated to one of said peripheral portions for guiding said thread in such a manner between said inlet element and said outlet element that it cooperates successively with said first and said second peripheral portions and is placed on an associated one of said peripheral portions in a supplying position of said guiding elements along a greater peripheral angle than in a non supplying position of said guiding elements, said thread guiding device having at least two separate control levers, each control lever mounting one of said guiding elements.

11. A thread supplying device as defined in claim 10, wherein both said peripheral portions have identical thread supplying properties.

12. A thread supplying device as defined in claim 11; and further comprising spring means including a spring which prestresses each of said control levers in a position in which said guiding elements mounted on said control levers assume said non supplying position.

13. A thread supplying device as defined in claim 1, wherein said friction surface of said first peripheral portion has a V-shaped receiving groove for receiving the thread (12).

14. A thread supplying device as defined in claim 13, wherein said receiving groove (33) is limited by two wall parts which form an angle of approximately 90°.

* * * * *